US012523108B2

(12) United States Patent
Varghese

(10) Patent No.: US 12,523,108 B2
(45) Date of Patent: Jan. 13, 2026

(54) WIRELINE POWERED DOWN JARRING DEVICE AND METHOD

(71) Applicant: Schlumberger Technology Corporation, Sugar Land, TX (US)

(72) Inventor: Mathew Varghese, Mussafah (AE)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/766,203

(22) Filed: Jul. 8, 2024

(65) Prior Publication Data

US 2025/0020036 A1 Jan. 16, 2025

Related U.S. Application Data

(60) Provisional application No. 63/512,324, filed on Jul. 7, 2023.

(51) Int. Cl.
*E21B 31/107* (2006.01)
*E21B 47/12* (2012.01)

(52) U.S. Cl.
CPC ..... *E21B 31/107* (2013.01); *E21B 47/12* (2013.01)

(58) Field of Classification Search
CPC ..... E21B 31/107; E21B 31/06
See application file for complete search history.

(56) References Cited

U.S. PATENT DOCUMENTS 3,203,491 A * 8/1965 Turley ..... E21B 31/06 166/99
4,007,790 A * 2/1977 Henning ..... E21B 31/1075 166/299
4,333,542 A * 6/1982 Taylor ..... E21B 31/107 175/302
6,230,802 B1 * 5/2001 Duhon ..... E21B 28/00 166/278
7,347,273 B2 * 3/2008 George ..... E21B 23/006 166/138
8,789,598 B1 7/2014 Micak
9,822,598 B2 11/2017 Miller
9,988,869 B2 6/2018 Kartha
10,655,415 B2 5/2020 Castillo
2009/0020287 A1 * 1/2009 Evans ..... E21B 31/1135 166/301
2015/0204153 A1 7/2015 Steine
2016/0102514 A1 4/2016 Miller
2016/0356111 A1 12/2016 Castillo
2017/0030159 A1 2/2017 Vick, Jr.
2017/0175475 A1 6/2017 Kartha
2019/0017340 A1 1/2019 Clemens

FOREIGN PATENT DOCUMENTS

CN 112576216 A 3/2021
WO 2015171161 A1 11/2015

OTHER PUBLICATIONS

Search Report and Written Opinion of International Application No. PCT/US2024/036994 dated Oct. 18, 2024, 9 pages.

* cited by examiner

*Primary Examiner* — Shane Bomar
(74) *Attorney, Agent, or Firm* — Jeffrey D. Frantz

(57) ABSTRACT

Embodiments presented provide for a jarring device. The jarring device is used in downhole environments during hydrocarbon recovery operations. Embodiments also provide a method for safe use of a jarring device to enable freeing stuck components without damaging wireline equipment.

20 Claims, 5 Drawing Sheets

WIRELINE POWERED DOWN JARRING DEVICE AND METHOD

CROSS-REFERENCE TO RELATED APPLICATIONS

The present application claims priority to U.S. Provisional Application No. 63/512,324 dated Jul. 7, 2023, the entirety of which is incorporated by reference.

FIELD OF THE DISCLOSURE

Aspects of the disclosure relate to wireline activities used in hydrocarbon recovery operations. More specifically, aspects of the disclosure relate to a wireline powered jarring device for hydrocarbon recovery operations.

BACKGROUND

Hydrocarbon reservoirs are becoming increasingly smaller and more challenging to access. This trend necessitates continuous exploration and adaptation to recover hydrocarbons efficiently. Researchers and engineers work tirelessly to develop novel techniques that can unlock these precious resources.

Downhole operations heavily rely on cables for data transmission, power supply and support of downhole equipment. Unfortunately, these cables often suffer damage during use. When cables become compromised, work stoppages occur as the damage is either repaired or the damaged cable is replaced. The primary culprit leading to such damage is the existence of jarring events. These jarring events are often used to free stuck components within the wellbore. These events, necessary for operational success, may stretch the cable or harm its protective cladding. In light of the potential damage, jarring events are conducted infrequently. Although infrequent, these jarring events are necessary from time to time.

Conventional production activities prioritize avoiding cable stretching or damage. This cautious approach; however, sometimes leads to cables being improperly sized for specific projects. Balancing cable robustness with operational requirements becomes critical. Engineers must strike a delicate balance to ensure cables withstand the rigors of downhole operations while not being too heavy for the intended purpose. There is a desire among field engineering staff to use the lightest cable possible to enhance field operational speed.

To address cable damage, cables must be designed to withstand jarring events without compromising their integrity. Factors like tensile strength, flexibility, and resistance to abrasion play a crucial role. Properly engineered cables minimize downtime, enhance efficiency, and reduce the need for frequent replacements.

Beyond damage prevention, cost-effective hydrocarbon recovery methods are desired. Investing in durable cables that withstand jarring events contributes to overall project costs. It is therefore more economical to use standard cables and prevent these cables from becoming damaged during operations. These solutions optimize resource utilization and reduce operational costs.

Faster production of hydrocarbons from fields is essential for meeting energy demands. Well-designed cables facilitate rapid data transmission and power delivery, ultimately enhancing productivity. Speedier recovery processes lead to optimized resource utilization and increased output.

Finally, safety remains paramount. Conducting downhole wellbore activities safely ensures both operational success and personnel well-being. Proper cable management, preventive maintenance, and adherence to safety protocols are non-negotiable. Further advantages are provided by minimizing wellbore "rework" or expensive "fishing" procedures to retail stuck components.

There is a need to provide an apparatus and methods that are easier to operate than conventional apparatus and methods to prevent cable damage. These apparatus and methods may utilize standardized wireline, limiting specialized equipment and allowing for more interchangeable parts in different wellbores.

There is a further need to provide apparatus and methods that do not have the drawbacks discussed above, namely overstressed cables, wellbore rework and the use of specialized arrangements.

There is a still further need to reduce economic costs associated with operations and apparatus described above with conventional tools. The reduction in economic costs may be derived from the use of standardized components within wellbores. Reduced economic costs may also be achieved by providing methods and apparatus that are not complicated in use or construction.

There is a still further need to provide a method for jarring equipment in a downhole environment that does not compromise the structural integrity of the cables yet also enhances downhole operations by quickly addressing stuck downhole components in subterranean wellbores.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, a method for jarring a device to be jarred stuck in a downhole wellbore is disclosed. The method may comprise running a jarring device downhole on a wireline cable. The method may further comprise setting a device weight of the jarring device on to the device to be jarred. The method may further comprise coupling the weight onto the device to be jarred. The method may further comprise actuating an actuator on the jarring device. The method may further comprise pulling the jarring device toward a surface location, lifting the weight of the jarring device. The method may further comprise turning off the actuator on the jarring device. The method may further comprise dropping the weight. The method may further comprise jarring the device to be jarred with the dropped weight.

In another example embodiment, an arrangement for jarring a device located in a downhole environment is described. The arrangement may comprise a housing defining an interior volume. The arrangement may also comprise a metallic weight configured to be placed within the interior volume of the housing and moved from a downhole position to an up-hole position within the housing. The arrangement may also comprise a magnet arrangement configured to switch from an activated state to a deactivated state and wherein in the activated state, the magnet attracts and holds the metallic weight, the magnet arrangement placed within the interior volume at a top of the housing. The arrangement may also comprise an actuator connected to the magnet arrangement, the actuator configured to switch the magnet arrangement from the activated state to the deactivated state, the actuator placed within the interior volume of the housing. The arrangement may also comprise a motor attached to the actuator, the motor causing the actuator to switch from the activated state to the deactivated state. The arrangement may also comprise a coil spring configured with an inside surface and an outside surface, the coil spring placed within the housing, the coil spring configured to expand in diameter from a first diameter to an expanded diameter. The arrangement may also comprise a rod configured to fit within the inside surface of the coil spring and spread a portion of the coil spring to an expanded diameter. The arrangement may also comprise a solenoid configured to move a rod from an actuated position to a deactuated position. The arrangement may also comprise an electrical system configured to supply electricity to the magnet arrangement, the actuator, the motor, and the solenoid, and a latching mechanism, to grip the outside surface of the coil spring when the coil spring is in the expanded diameter configuration.

In another example embodiment, an arrangement for jarring a device located in a downhole environment is disclosed. The arrangement may comprise a housing defining an interior volume. The arrangement may also comprise a metallic weight configured to be placed within the interior volume of the housing and moved from a downhole position to an up-hole position within the housing. The arrangement may also comprise a magnet arrangement configured to switch from an activated state to a deactivated state and wherein in the activated state, the magnet attracts and holds the metallic weight, the magnet arrangement placed within the interior volume at a top of the housing. The arrangement may also comprise an actuator connected to the magnet arrangement, the actuator configured to switch the magnet arrangement from the activated state to the deactivated state, the actuator placed within the interior volume of the housing. The arrangement may also comprise a motor attached to the actuator, the motor causing the actuator to switch from the activated state to the deactivated state. The arrangement may also comprise a coil spring configured with an inside surface and an outside surface, the coil spring placed within the housing, the coil spring configured to expand in diameter from a first diameter to an expanded diameter. The arrangement may also comprise a rod configured to fit within the inside surface of the coil spring and spread a portion of the coil spring to an expanded diameter. The arrangement may also comprise a solenoid configured to move a rod from an actuated position to a deactuated position. The arrangement may also comprise an electrical system configured to supply electricity to the actuator, the motor, the magnet arrangement, and the solenoid. The arrangement may also comprise a latching mechanism to grip the outside surface of the coil spring when the coil spring is in the expanded diameter configuration.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted; however, that the appended drawings illustrate only typical embodiments of this disclosure and are; therefore, not be considered limiting of its scope, for the disclosure may admit to other equally effective embodiments.

Figures 1A, 1B, 1C, 1D:
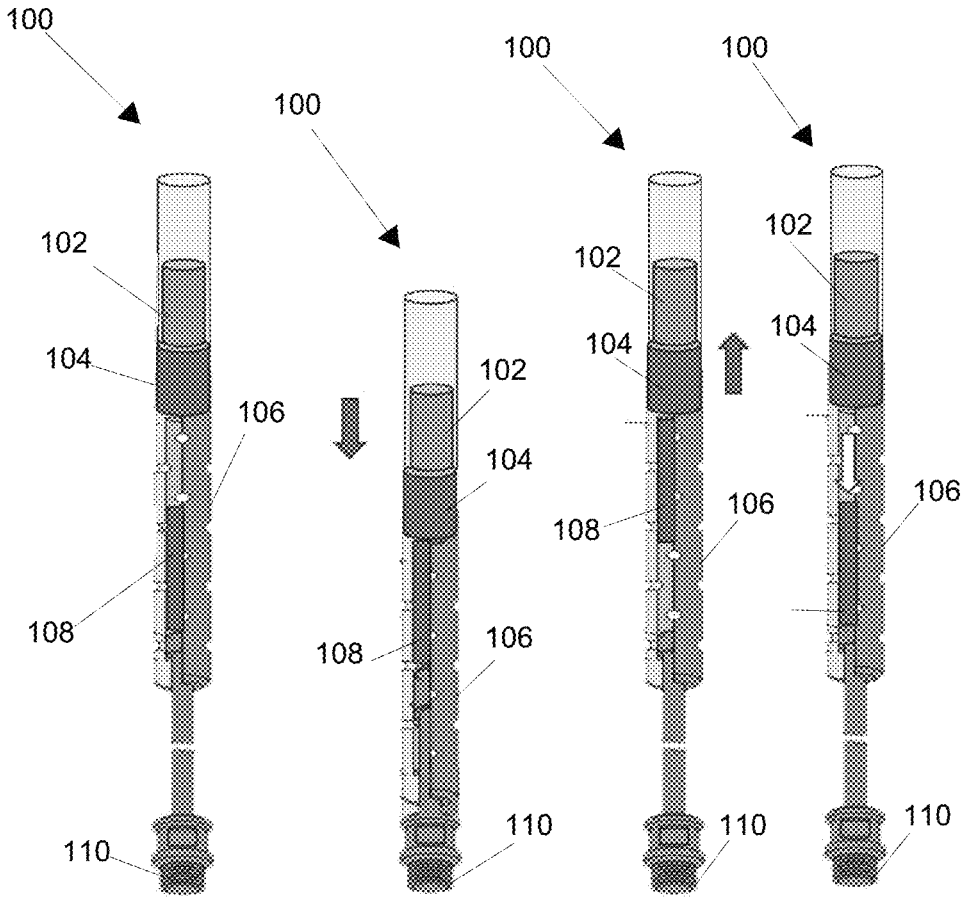
FIGS. 1A, 1B, 1C, and 1D are a schematic representation of a wireline down jarring device/arrangement in accordance with one example embodiment of the disclosure.

To facilitate understanding, identical reference numerals have been used, where possible, to designate identical elements that are common to the figures ("FIGS."). It is contemplated that elements disclosed in one embodiment may be beneficially utilized on other embodiments without specific recitation.

DETAILED DESCRIPTION

In the following, reference is made to embodiments of the disclosure. It should be understood; however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments, and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers, and/or sections, these elements, components, regions, layers, and/or sections should not be limited by these terms. These terms may be only used to distinguish one element, components, region, layer, or section from another region, layer, or section. Terms such as "first", "second", and other numerical terms, when used herein, do not imply a sequence or order unless clearly indicated by the context. Thus, a first element, component, region, layer, or section discussed herein could be termed a second element, component, region, layer, or section without departing from the teachings of the example embodiments.

When an element or layer is referred to as being "on", "engaged to", "connected to", or "coupled to" another element or layer, it may be directly on, engaged, connected, coupled to the other element or layer, or interleaving elements or layers may be present. In contrast, when an element is referred to as being "directly on", "directly engaged to", "directly connected to", or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood; however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Embodiments of the disclosure provide a method and arrangement for creating a jarring effect on a downhole device. From time to time, downhole devices become lodged within wellbores. Accumulation of sand, grit, rock, and other materials may bind downhole devices to the inner wall of the wellbore. During extraction of the downhole device, the binding may be of such significance that excessive pulling on the wireline may damage the armor or other components of the wireline. It is therefore of great importance to limit the overstressing of wireline components when these unfortunate events occur. Embodiments allow the use of standardized wireline or cables to dislodge the stuck downhole device. The method embodiments presented allow for a simplistic method for dislodging the device that does not require specialized training by field workers.

Referring to FIG. 1A, a cross-section of an arrangement 100 to create a jarring action on a downhole tool is illustrated. The arrangement 100 has an actuator 102 that is attached to a latching mechanism 104. The latching mechanism is attached to a perforated housing 106. In FIG. 1A, a weight 108 is lowered compared to the actuator 102. The arrangement 100 is located above a downhole tool, 110, that is stuck within a wellbore. Referring to FIG. 1B, the arrangement 100 is lowered with the latching mechanism 104 connecting to the weight 108. In FIG. 1C, the arrangement 100 is pulled up, consequently pulling up the weight 108, thereby storing potential energy within the arrangement 100. In FIG. 1D, the weight 108 may be dropped, as shown by the accompanying arrow, thereby causing a jarring action.

Figure 2A:
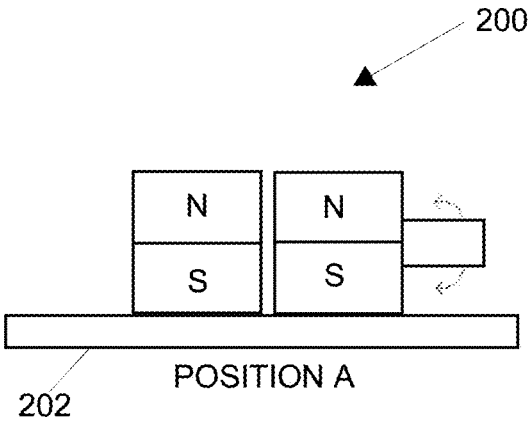
FIGS. 2A and 2B are embodiments of switchable magnets that may be used with the wireline down jarring device.

Referring to FIG. 2A, a cross-sectional view of switchable magnets 200 used in embodiments of the disclosure are presented. The magnets 200 are used, in one embodiment, within the latching mechanism 104 of FIG. 1. Such a position is defined as position A or activated. In FIG. 2A, two neodymium magnets 200 are presented with north pole portions of the magnets being placed vertically above corresponding south pole portions. In the position, a strong magnetic field is generated, thereby allowing for attraction of metallic material 202.

Figure 2B:
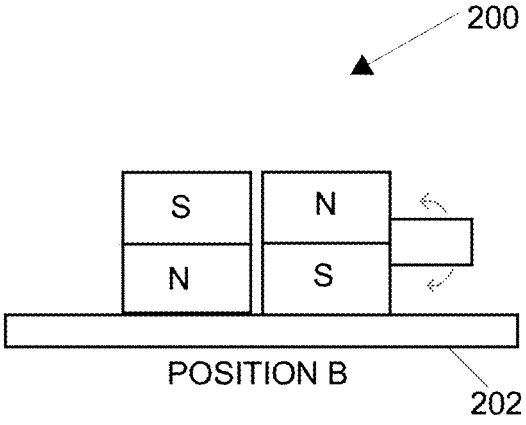

Referring to FIG. 2B, north/south positions for one of the magnets has been changed. This position is defined as Position B, or deactivated. In this position, the metallic material 202 is not attracted to the magnets 200 as the magnetic fields of the two magnets cancel each other out. The position of the magnets 200 may be performed through various means, such as having one set of magnets 200 that is rotatable. Although shown as a pair of magnets 200, any number of pairs may be used to have greater actuation capability. In embodiments, power may be provided to the magnets 200 through the wireline. Signal positioning for the magnets 200 may also be provided through wireline or wireless communication.

Figure 3A:
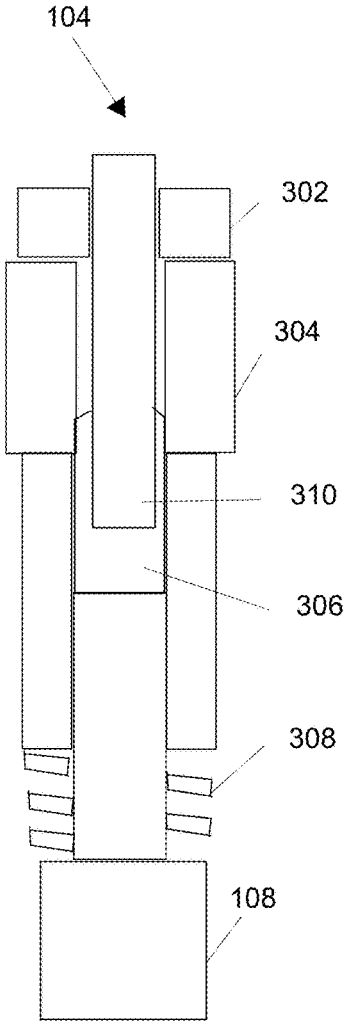
FIGS. 3A, 3B, and 3C are views of the solenoid-based latching mechanism for the wireline down jarring device.
Figure 3B:
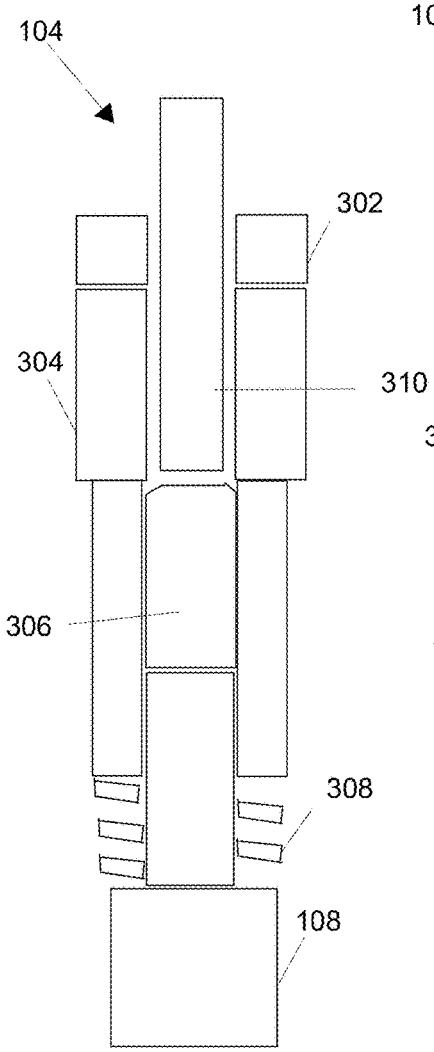
Figure 3C:
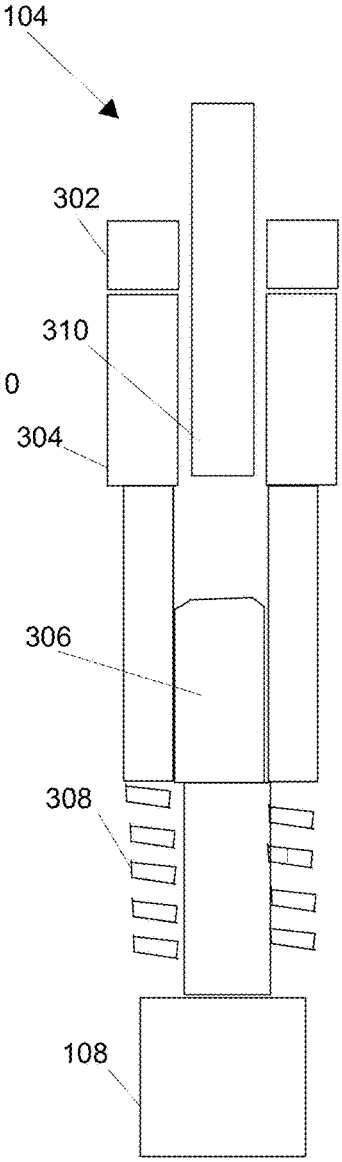

Referring to FIGS. 3A, 3B, and 3C, differing positions of the latching mechanism 104 of FIG. 1 are shown. The cross-section of the latching mechanism 104 presents a solenoid 302, a collet 304, a spring catch 306, spring 308, a rod 310, and weight 108. The solenoid 302, through electrification, provides for positioning of the rod 310 within the solenoid 302. In embodiments, the solenoid 302 may be configured to have the rod 310 achieve a retracted or a free position. In FIG. 3A, the solenoid 302 is configured such that the rod 310 is in an inserted position. In this position, the rod 310 insertion within the spring catch 306 allows for the spring 308 to be retained within the spring catch 306 as the diameter of the rod 310 causes the diameter of the spring 308 to expand, thereby allowing the outer surface of the spring to be captured by the spring catch 306. The precise machining of the collet 304 allows for stepwise movement of the spring 308 within the spring catch 306. In embodiments, the weight 108 may be of a streamlined design such that frictional forces from the entraining fluid are minimized, thereby delivering maximum possible energy to the stuck downhole device.

Referring to FIG. 3B, the rod 310 is withdrawn from the collet 304 at the top of the drop cycle for the weight 108. With the rod being withdrawn from the collet 304, the spring 308 does not catch within the spring catch 306.

Referring to FIG. 3C, the weight drops as the spring 308 does not catch within the spring catch 306 within the collet. This causes the jarring action desired, as the potential energy stored becomes kinetic energy that is imparted into the stuck downhole component.

Figures 4A, 4B, 4C, 4D:
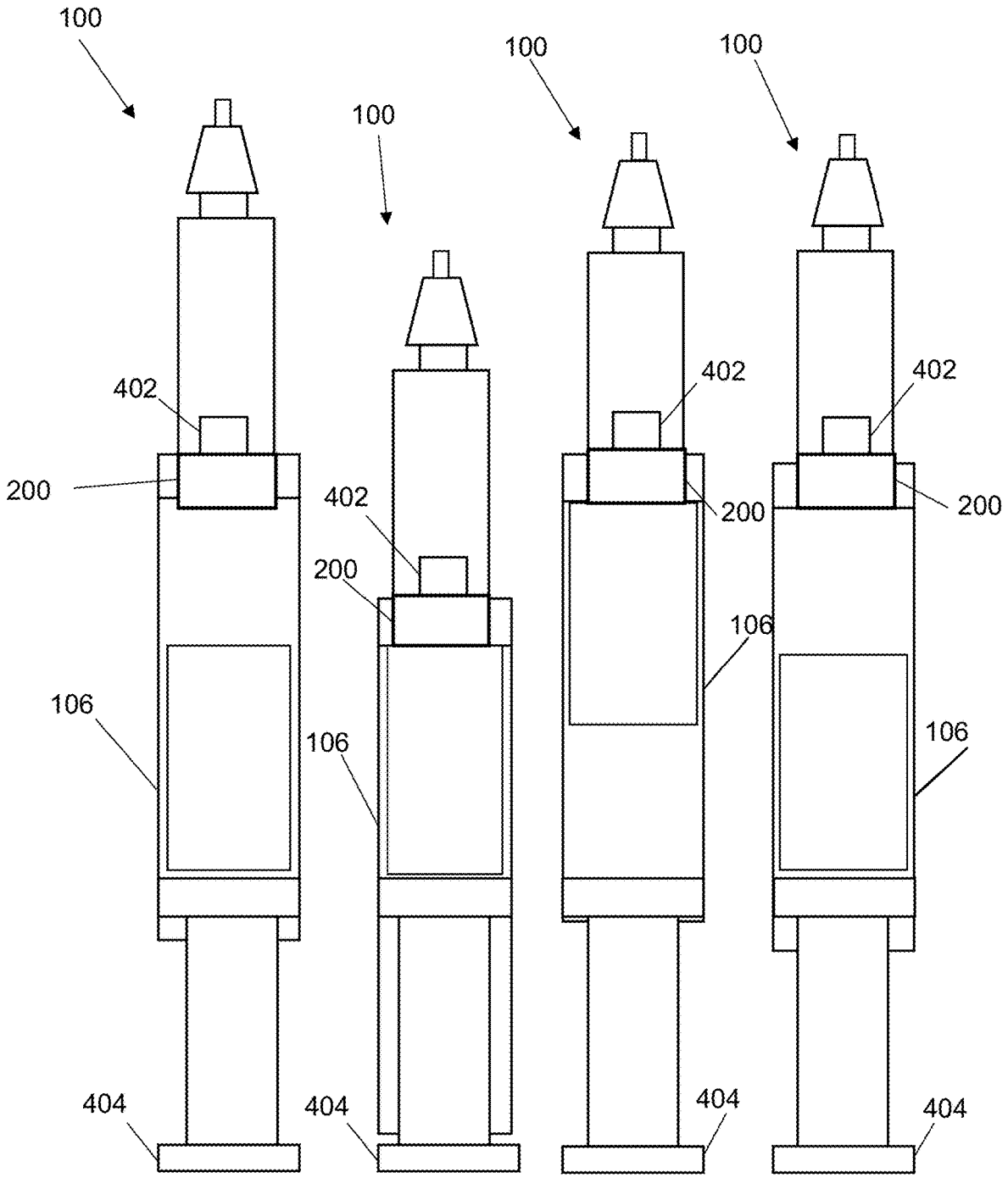
FIGS. 4A, 4B, 4C, and 4D progressively show the wireline down jarring device in different states during a jarring procedure.

Referring to FIG. 4A, the overall arrangement 100 is illustrated in operation. At the start of the cycle, the magnets of FIG. 2 are positioned directly below a motor 402 that is provided electrical energy through the wireline. The motor 402 has the ability to slide the arrangement 100 up and down on the wireline. The device to be jarred 404 is located below the arrangement 100. The motor 402 is actuated and the arrangement 100 descends, as shown in FIG. 4B, and is placed upon the top of the device to be jarred 404. In FIG. 4C, the magnet 200 is actuated, thereby causing attraction between the magnet and the weight 108. Lifting of the weight 108 within the arrangement 100 is accomplished through actuation of the motor 402, thereby storing potential energy within the arrangement 100. As will be understood, using the motor 402 to lift the weight 108 prevents overstressing the supporting wireline as the motor 402 is used to gather potential energy for striking the device to be jarred 404 rather than using excessive tension on the wireline. In other embodiments, a winch from the surface may be used to raise the overall arrangement. Referring to FIG. 4D, the magnet 200 is placed in Position B, deactivated, and attraction between the magnet 200 and the weight 108 is minimized. Gravity causes the weight 108 to fall and strike the device to be jarred 404, thus loosening the device. In embodiments, a housing may be used to confine the weight 108 during lifting activities and jarring/striking activities. The housing 106 may be configured with holes to allow for pressure equalization during periods of the weight dropping through downhole fluid prior to a strike. As will be understood, an electrical system (deleted for clarity of view) is provided to supply electricity to the magnet 200, the motor 402, the solenoid 302 (deleted for clarity of view) and the actuator 102 (deleted for clarity of view). This electrical energy may be supplied, in one embodiment, through wireline or a cable. In other embodiments, a separate battery may accompany the arrangement 100 to provide the needed energy. Computing devices may also accompany the arrangement to allow for signal communication between the surface and the arrangement 100. Such computing devices may incorporate sensors to allow surface-based engineers the ability to determine the state of actuation of the components of the arrangement.

Figure 5:
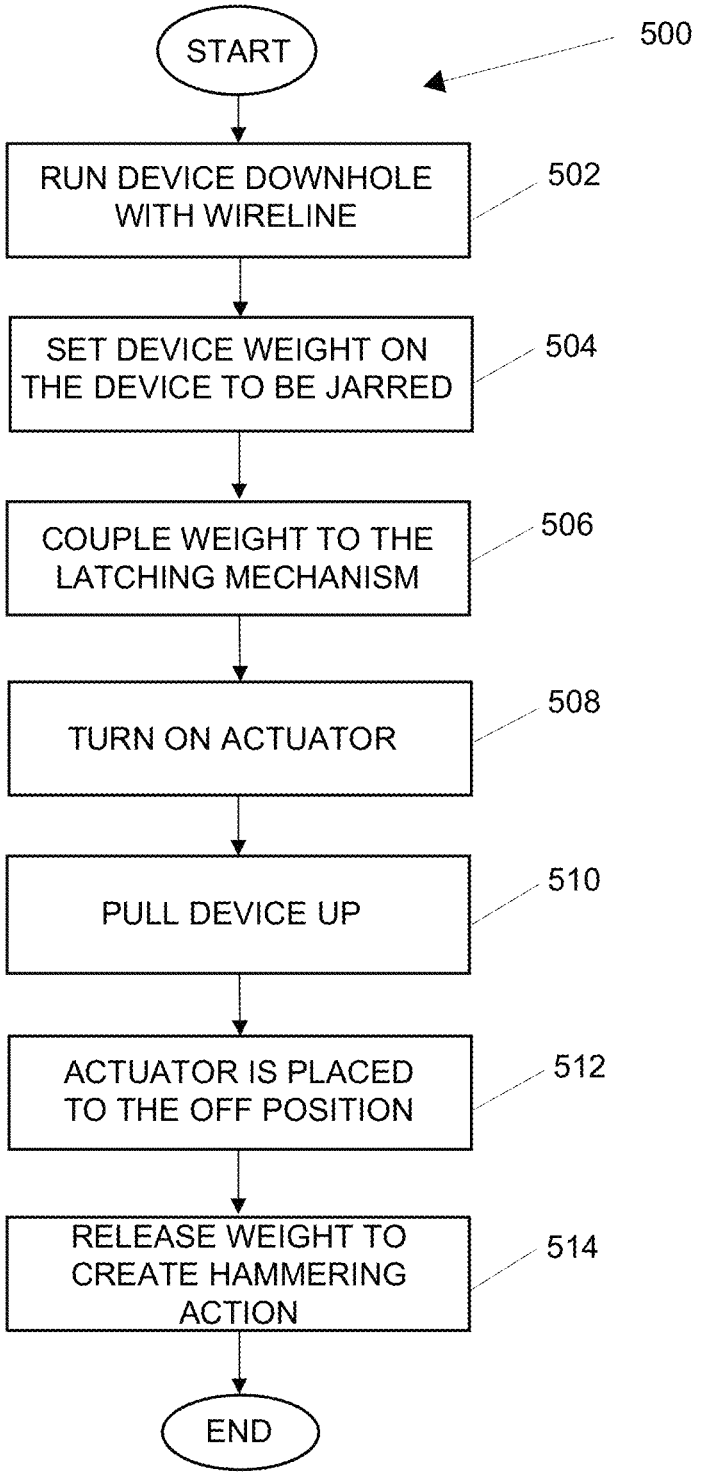
FIG. 5 is a method of jarring a wireline in accordance with one example embodiment of the disclosure.

Referring to FIG. 5, a method 500 pertaining to one example embodiment of the disclosure is presented. The method may comprise, at 502, running a device downhole with/on wireline. The device may be a latching mechanism with jarring device. The method may also comprise, at 504, setting a device weight on a device to be jarred. As will be understood, a device that is to be jarred may include a device that is temporarily stuck within the wellbore. At 506, the method continues with coupling the weight to the latching mechanism. At 508, the method continues further with activating (turning on) an actuator. In embodiments, the turning on of the actuator may be performed in a timed fashion or a signal may be sent from the surface to the actuator to initiate actuation. With the actuator in the "on" position, successive method steps may be performed.

After step 508, the method continues at 510 with pulling the device up. This step elevates the internal weight preparing for release and initiation of the jarring motion. After 510, the actuator is placed into the off position at 512. The method continues with releasing the weight at 514, thereby causing the jarring/hammering action to loosen the stuck downhole component. After 512, it may be determined that the downhole component is not loosened. If it is not loosened, the method 500 may be repeated again from step 504 for successive times until the downhole device is loosened. Once loosened, the downhole device may be withdrawn from the wellbore or may be lowered past the point of binding to accomplish needed downhole testing or methods.

Embodiments of the disclosure provide an apparatus and method that are easier to operate than conventional apparatus and methods to prevent cable damage. These apparatus and methods utilize standardized wireline, limiting specialized equipment and allowing for more interchangeable parts in different wellbores.

The apparatus and methods do not have the drawbacks discussed above, namely overstressed cables, wellbore rework, and the use of specialized arrangements.

Aspects of the disclosure reduce economic costs associated with operations and apparatus described above with conventional tools. The reduction in economic costs are derived from use of standardized components within wellbores. Reduced economic costs are also be achieved by providing methods and apparatus that are not complicated in use or construction.

The methods described do not compromise the structural integrity of the cables. The method described enhances downhole operations by quickly addressing stuck downhole components in subterranean wellbores.

Example embodiments of the claims are presented next. The example embodiments described should not be considered to narrow the scope of the disclosure. In one example embodiment, a method for jarring a device to be jarred stuck in a downhole wellbore is disclosed. The method may comprise running a jarring device downhole on a wireline cable. The method may further comprise setting a device weight of the jarring device on to the device to be jarred. The method may further comprise coupling the weight onto the device to be jarred. The method may further comprise actuating an actuator on the jarring device. The method may further comprise pulling the jarring device toward a surface location, lifting the weight of the jarring device. The method may further comprise turning off the actuator on the jarring device. The method may further comprise dropping the weight. The method may further comprise jarring the device to be jarred with the dropped weight.

In another example embodiment, the method may be performed wherein the coupling of the weight onto the device to be jarred is performed through a latching mechanism.

In another example embodiment, the method may be performed wherein the actuating of the actuator on the jarring device is performed by sending a signal from an up-hole location to the jarring device over the wireline cable.

In another example embodiment, the method may further comprise determining if the device to be jarred is loose within a wellbore.

In another example embodiment, the method may be performed wherein when the device to be jarred is not loosened within the wellbore, repeating the method.

In another example embodiment, an arrangement for jarring a device located in a downhole environment is described. The arrangement may comprise a housing defining an interior volume. The arrangement may also comprise a metallic weight configured to be placed within the interior volume of the housing and moved from a downhole position to an up-hole position within the housing. The arrangement may also comprise a magnet arrangement configured to switch from an activated state to a deactivated state and wherein in the activated state, the magnet attracts and holds the metallic weight, the magnet arrangement placed within the interior volume at a top of the housing. The arrangement may also comprise an actuator connected to the magnet arrangement, the actuator configured to switch the magnet arrangement from the activated state to the deactivated state, the actuator placed within the interior volume of the housing. The arrangement may also comprise a motor attached to the actuator, the motor causing the actuator to switch from the activated state to the deactivated state. The arrangement may also comprise a coil spring, configured with an inside surface and an outside surface, the coil spring placed within the housing, the coil spring configured to expand in diameter from a first diameter to an expanded diameter. The arrangement may also comprise a rod configured to fit within the inside surface of the coil spring and spread a portion of the coil spring to an expanded diameter. The arrangement may also comprise a solenoid configured to move a rod from an actuated position to a deactuated position. The arrangement may also comprise a latching mechanism to grip the outside surface of the coil spring when the coil spring is in the expanded diameter configuration.

In another example embodiment, the arrangement may be configured wherein the weight is configured to minimize hydraulic friction forces on the weight when dropped through a fluid.

In another example embodiment, the arrangement may be configured wherein the magnet arrangement is configured from at least two neodymium magnets.

In another example embodiment, the arrangement may be configured wherein the housing has a collet.

In another example embodiment, the arrangement may be configured wherein the latching mechanism to grip the outside surface of the coil spring when the coil spring is in the expanded diameter configuration, is placed on an inside surface of the housing.

In another example embodiment, the arrangement may be configured wherein the housing is configured with an arrangement to allow fluid to penetrate within the housing.

In another example embodiment, the arrangement may be configured wherein the arrangement is a series of penetrations within the housing.

In another example embodiment, an arrangement for jarring a device located in a downhole environment is disclosed. The arrangement may comprise a housing defining an interior volume. The arrangement may also comprise a metallic weight configured to be placed within the interior volume of the housing and moved from a downhole position to an up-hole position within the housing. The arrangement may also comprise a magnet arrangement configured to switch from an activated state to a deactivated state and wherein in the activated state, the magnet attracts and holds the metallic weight, the magnet arrangement placed within the interior volume at a top of the housing. The arrangement may also comprise an actuator connected to the magnet arrangement, the actuator configured to switch the magnet arrangement from the activated state to the deactivated state, the actuator placed within the interior volume of the housing. The arrangement may also comprise a motor attached to the actuator, the motor causing the actuator to switch from the activated state to the deactivated state. The arrangement may also comprise a coil spring configured with an inside surface and an outside surface, the coil spring placed within the housing, the coil spring configured to expand in diameter from a first diameter to an expanded diameter. The arrangement may also comprise a rod configured to fit within the inside surface of the coil spring and spread a portion of the coil spring to an expanded diameter. The arrangement may also comprise a solenoid configured to move a rod from an actuated position to a deactuated position. The arrangement may also comprise an electrical system configured to supply electricity to the actuator, the motor, the magnet arrangement, and the solenoid. The arrangement may also comprise a latching mechanism to grip the outside surface of the coil spring when the coil spring is in the expanded diameter configuration.

In another example embodiment, the arrangement may be configured wherein the electrical system is configured to receive electricity from a wireline connection and distribute the electricity to each of the solenoid, the actuator, the motor, and the magnet arrangement.

In another example embodiment, the arrangement may be configured wherein the electrical system is configured with a battery to supply the electricity.

In another example embodiment, the arrangement may be configured wherein the magnet arrangement is configured from at least two neodymium magnets.

In another example embodiment, the arrangement may be configured wherein the housing is configured with an arrangement to allow fluid to penetrate within the housing.

In another example embodiment, the arrangement may be configured wherein the arrangement is a series of penetrations within the housing.

In another example embodiment, the arrangement may be further configured with a sensor package configured to monitor activities of the arrangement and convey data to an up-hole environment.

In another example embodiment, the arrangement may be configured wherein the sensor package is configured with a wireline transducer configured to send and receive signals to and from the arrangement.

In the preceding description, description is provided related to measurements obtained during wireline operations generally performed, as described above. As will be understood, various changes and alterations may be accomplished during the attainment of the desired measurements and as such, methods described should not be considered limiting.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A method for jarring a device to be jarred stuck in a downhole wellbore, comprising:

running a jarring device downhole on a wireline cable;

setting a device weight of the jarring device on to the device to be jarred;

coupling the weight onto the device to be jarred;

actuating an actuator on the jarring device;

pulling the jarring device toward a surface location, lifting the weight of the jarring device;

turning off the actuator on the jarring device;

dropping the weight; and jarring the device to be jarred with the dropped weight.

2. The method according to claim 1, wherein the coupling of the weight onto the device to be jarred is performed through a latching mechanism.

3. The method according to claim 1, wherein the actuating of the actuator on the jarring device is performed by sending a signal from an up-hole location to the jarring device over the wireline cable.

4. The method according to claim 1, further comprising determining if the device to be jarred is loose within a wellbore.

5. The method according to claim 4, wherein when the device to be jarred is not loosened within the wellbore, repeating the method.

6. An arrangement for jarring a device located in a downhole environment, comprising:

a housing defining an interior volume;

a metallic weight configured to be placed within the interior volume of the housing and moved from a downhole position to an up-hole position within the housing;

a magnet arrangement configured to switch from an activated state to a deactivated state and wherein in the activated state, the magnet attracts and holds the metallic weight, the magnet arrangement placed within the interior volume at a top of the housing;

an actuator connected to the magnet arrangement, the actuator configured to switch the magnet arrangement from the activated state to the deactivated state, the actuator placed within the interior volume of the housing;

a motor attached to the actuator, the motor causing the actuator to switch from the activated state to the deactivated state;

a coil spring configured with an inside surface and an outside surface, the coil spring placed within the housing, the coil spring configured to expand in diameter from a first diameter to an expanded diameter;

a rod configured to fit within the inside surface of the coil spring and spread a portion of the coil spring to an expanded diameter;

a solenoid configured to move the rod from an actuated position to a deactuated position; and a latching mechanism to grip the outside surface of the coil spring when the coil spring is in the expanded diameter configuration.

7. The arrangement according to claim 6, wherein the weight is configured to minimize hydraulic friction forces on the weight when dropped through a fluid.

8. The arrangement according to claim 6, wherein the magnet arrangement is configured from at least two neodymium magnets.

9. The arrangement according to claim 6, wherein the housing has a collet.

10. The arrangement according to claim 6, wherein the latching mechanism to grip the outside surface of the coil spring when the coil spring is in the expanded diameter configuration is placed on an inside surface of the housing.

11. The arrangement according to claim 6, wherein the housing is configured with an arrangement to allow fluid to penetrate within the housing.

12. The arrangement according to claim 11, wherein the arrangement is a series of penetrations within the housing.

13. An arrangement for jarring a device located in a downhole environment, comprising:

a housing defining an interior volume;

a metallic weight configured to be placed within the interior volume of the housing and moved from a downhole position to an up-hole position within the housing;

a magnet arrangement configured to switch from an activated state to a deactivated state and wherein in the activated state, the magnet attracts and holds the metallic weight, the magnet arrangement placed within the interior volume at a top of the housing;

an actuator connected to the magnet arrangement, the actuator configured to switch the magnet arrangement from the activated state to the deactivated state, the actuator placed within the interior volume of the housing;

a motor attached to the actuator, the motor causing the actuator to switch from the activated state to the deactivated state;

a coil spring configured with an inside surface and an outside surface, the coil spring placed within the housing, the coil spring configured to expand in diameter from a first diameter to an expanded diameter;

a rod configured to fit within the inside surface of the coil spring and spread a portion of the coil spring to an expanded diameter;

a solenoid configured to move the rod from an actuated position to a deactuated position;

an electrical system configured to supply electricity to the actuator, the motor, the magnet arrangement and the solenoid; and a latching mechanism to grip the outside surface of the coil spring when the coil spring is in the expanded diameter configuration.

14. The arrangement according to claim 13, wherein the electrical system is configured to receive electricity from a wireline connection and distribute the electricity to each of the solenoid, the actuator, the motor, and the magnet arrangement.

15. The arrangement according to claim 13, wherein the electrical system is configured with a battery to supply the electricity.

16. The arrangement according to claim 13, wherein the magnet arrangement is configured from at least two neodymium magnets.

17. The arrangement according to claim 13, wherein the housing is configured with an arrangement to allow fluid to penetrate within the housing.

18. The arrangement according to claim 17, wherein the arrangement is a series of penetrations within the housing.

19. The arrangement according to claim 13, further comprising a sensor package configured to monitor activities of the arrangement and convey data to an up-hole environment.

20. The arrangement according to claim 19, wherein the sensor package is configured with a wireline transducer configured to send and receive signals to and from the arrangement.

* * * * *